US006767059B1

(12) United States Patent
Rhoades

(10) Patent No.: US 6,767,059 B1
(45) Date of Patent: Jul. 27, 2004

(54) SWING

(76) Inventor: Dorman R. Rhoades, 110 N. Creamery St., Eureka, IL (US) 61530

( * ) Notice: Subject to any disclaimer, the term of this patent is extended or adjusted under 35 U.S.C. 154(b) by 15 days.

(21) Appl. No.: 10/337,151

(22) Filed: Jan. 6, 2003

Related U.S. Application Data

(63) Continuation-in-part of application No. 09/693,493, filed on Oct. 20, 2000, now abandoned.
(60) Provisional application No. 60/160,528, filed on Oct. 20, 1999.

(51) Int. Cl.[7] ..... A47D 13/10
(52) U.S. Cl. ..... 297/277; 427/118
(58) Field of Search ..... 297/273, 277, 297/281; 472/118

(56) References Cited

U.S. PATENT DOCUMENTS 806,157 A * 12/1905 Martin
1,063,956 A * 6/1913 Carley
1,189,393 A * 7/1916 Shaw
1,335,776 A * 4/1920 Young
5,374,107 A * 12/1994 Schnitzler

* cited by examiner

*Primary Examiner*—Milton Nelson, Jr.
(74) *Attorney, Agent, or Firm*—Philip L. Bateman

(57) ABSTRACT

A swing moves with a front-to-back pendular motion. The swing contains an elevated support having two hooks spaced apart perpendicularly to the direction of motion of the swing. A horizontally-mounted subplatform with two sides is suspended from the hooks. A chair is suspended from the subplatform on each side by a front suspension member running from the front side corner of the subplatform to the front side of the chair and by a rear suspension member running from the rear side corner of the subplatform to the rear side of the chair.

14 Claims, 16 Drawing Sheets

Fig_10_
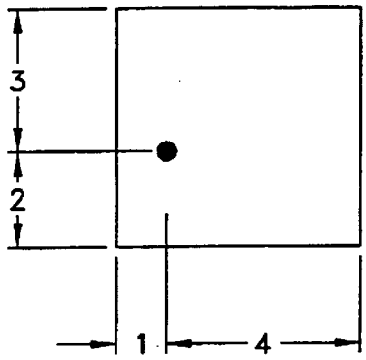
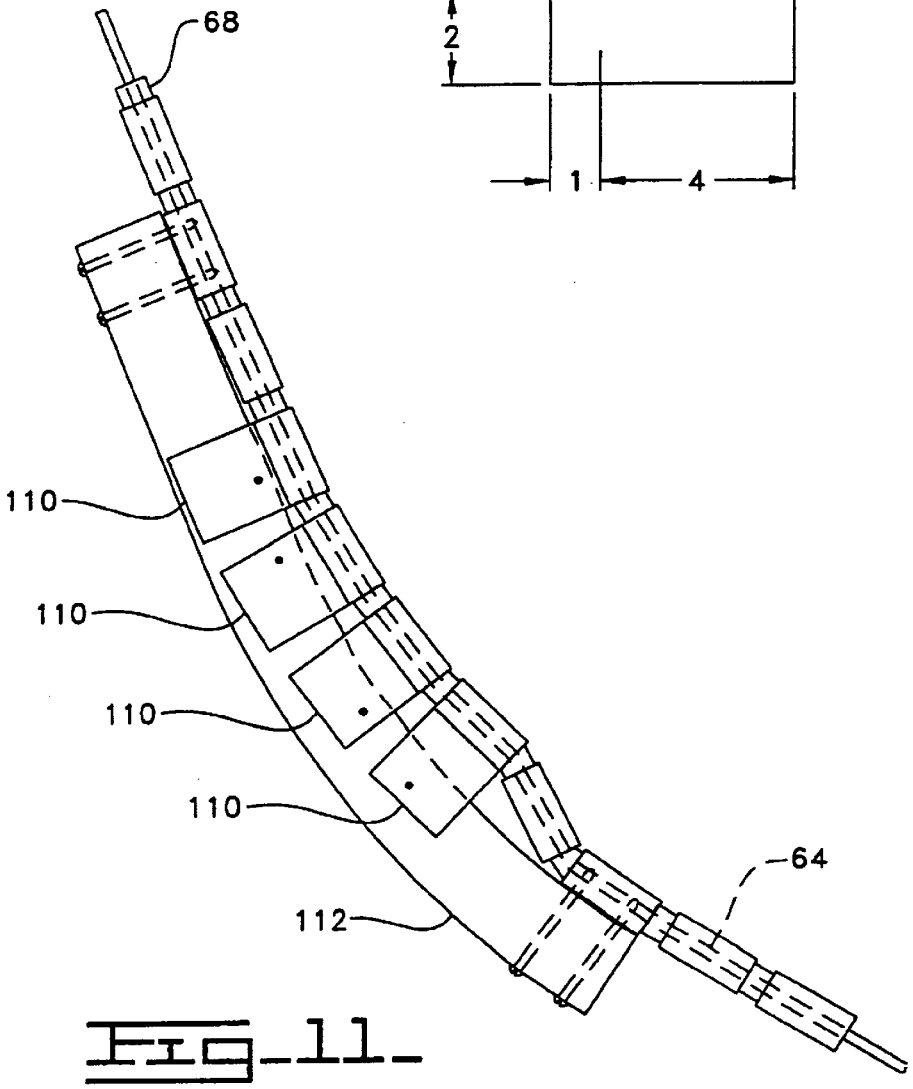
Fig_11_

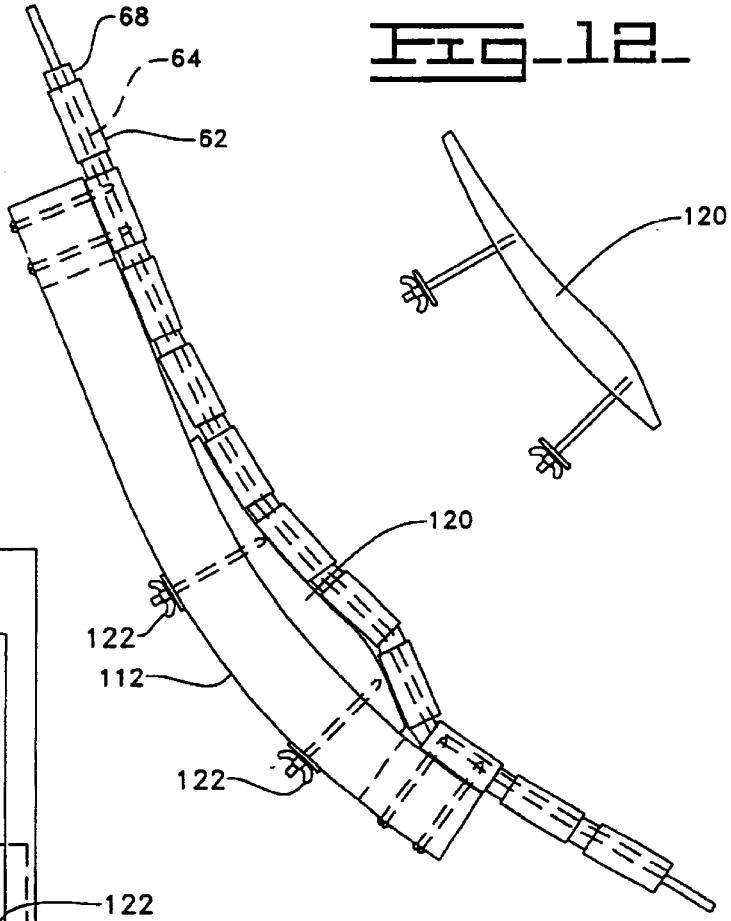
Fig_12_
Fig_13_
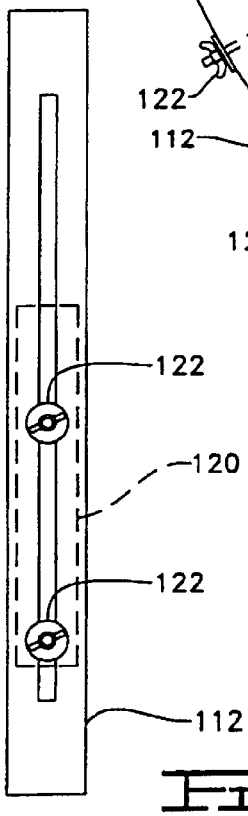
Fig_14_

SWING

CROSS-REFERENCE TO RELATED APPLICATIONS

This application is a continuation-in-part of U.S. patent application Ser. No. 09/693,493, filed Oct. 20, 2000, now abandoned; which claimed the benefit of U.S. Provisional Patent Application Serial No. 60/160,528, filed Oct. 20, 1999.

FIELD OF THE INVENTION

This invention relates to swings. More particularly, this invention relates to swings that move with a front-to-back pendular motion.

BACKGROUND OF THE INVENTION

Swings are suspended devices upon which one or more persons can sit or lie. The device may be a chair, seat, bench, chaise longue (also known as a chaise lounge), hammock, bed, or the like. The term "chair" is used herein to describe any such article. Swings are typically suspended from two or more overhead points and are designed for a pendular front-to-back motion. For example, Fry, U.S. Pat. No. 2,048,110, issued Jul. 21, 1936, discloses a swing consisting of a chair suspended by four chains that are connected to four separate overhead points. Sapienza, U.S. Pat. No. 3,889,944, issued Jun. 17, 1975, discloses a swing consisting of a chair suspended from two chains that are connected to two separate overhead points.

Hanging chairs are similar to swings in that they are suspended. However, unlike swings, hanging chairs are suspended from a single overhead point and are designed for motion in all horizontal directions. Hanging chairs typically contain a suspension alignment device that balances the chair. For example, Osterman, U.S. Pat. No. Des. 260,460, issued Sep. 1, 1981, discloses a hanging chair suspended from four ropes. The alignment of the four ropes is maintained by a horizontally-mounted square frame positioned above the chair. Each of the four ropes passes through a corner of the frame before converging at a single point. Halsall, U.S. Pat. No. Des. 281,206, issued Nov. 5, 1985, is similar except the suspension alignment device is X-shaped rather than square. Schnitzler, U.S. Pat. No. 5,374,107, issued Dec. 20, 1994, also discloses a hanging chair having a horizontally-mounted suspension alignment device. The term "swing" is used herein to refer to a device having a pendular front-to-back swinging motion, in contrast to hanging chairs that move in any horizontal direction.

The motion of a swing is pleasurable for people of all ages, although some prefer a slow, gentle motion with little displacement of the chair while others prefer a much faster motion with a much greater displacement. Most swings can be put into motion by either the occupants or an outside force, often another person. When a swing is put into motion by its occupant, the occupant must generally vigorously bend and extend the knees to alter the body's center of gravity in time with the pendular cycle of the swing. The very young, the elderly, and the physically handicapped are often incapable of this movement. Some swings are designed to make motion generation by the occupant easier. For example, the Fry swing discussed above contains a pivotally suspended footrest with two vertical bars that can also be operated by hand. The Sapienza swing discussed above contains a hand pull rope suspended from a stationary point that enables the occupant to move the swing. Despite the countless number of swings that have been disclosed, a demand still exists for a swing that provides a more pleasurable motion, that provides improved means for motion generation by its occupant, and that has greater adjustability.

SUMMARY OF THE INVENTION

The general object of this invention is to provide an improved swing. A more particular object is to provide a swing with a more pleasurable rolling motion. Another more particular object is to provide a swing with improved means for motion generation by its occupant(s). Another more particular object is to provide a swing with greater adjustability.

I have invented an improved swing of the type that moves with a front-to-back pendular motion. The swing comprises: (a) an elevated support having two hooks that are spaced apart perpendicularly to the direction of motion of the swing; (b) a horizontally-mounted subplatform having two sides, each side having a front corner and a rear corner, the subplatform being suspended from the support hooks; and (c) a chair having a front, a back, and two sides; the chair being suspended from the subplatform on each side by a front suspension member running from the front side comer of the subplatform to the front side of the chair and by a rear suspension member running from the rear side corner of the subplatform to the rear side of the chair.

The subplatform is primarily responsible for this swing's uniquely pleasurable rolling motion. The moving subplatform provides a moving pivot point for the chair and thereby changes the angle the chair makes to the horizon. Certain embodiments of the chair contain a foot treadle and/or a hand propellant that enable the occupant to easily generate motion.

BRIEF DESCRIPTION OF THE DRAWINGS

FIG. 10 is a detail of a lumbar support block showing the hole placement.

FIG. 11 is a side view of the lumbar support mechanism.

FIG. 12 is a detail of a sliding block.

FIG. 13 is a side view of a second embodiment of the lumbar support mechanism.

FIG. 14 is a rear view detail thereof.

REFERENCE NUMERALS IN DRAWINGS

| | | |
|---|---|---|
| 10 Support | 12 Support Hooks | 14 Top Flexible Chord Subplatform Suspension Member |
| 16 Subplatform | 18 Top Incremental Fasteners | 20 Bottom Incremental Fasteners |
| 22 Upper Member Propellant | 24 Connecting Member Propellant | 26 Lower Member Propellant |
| 28 Top-Side Retainer | 30 Bottom-Side Retainer | 32 Adjustable Hanging Plate |
| 34 Position Adjustment Holes/Plate | 36 Top Rigid Chord Subplatform Suspension Member | 38 Adjustment Holes Subplatform |
| 40 Removable Fastener | 50 Front Chair Suspension Member | 52 Rear Chair Suspension Member |
| 54 Connector | 60 Back Support Member | 62 Seat Member |
| 64 Seat Support | 66 Seat Support Tensioner | 68 Seat Member Spacer |
| 70 Front Support Member | 72 Seat Support Transition Cover | 74 Vertical Arm Rest Support |
| 76 Vertical Arm Rest Support Cover | 78 Horizontal Arm Rest Support | 80 Arm Rest |
| 82 Horizontal Arm Rest Support Cover | 84 Arm Rest To Back Fastener | 86 Slotted Plug |
| 88 Slotted Plug Retainer | 90 Arm Rest To Back Fastener Pin | 100 Foot Treadle |
| 102 Treadle Support | 104 Treadle Support Fastener | 106 Treadle Support Termination Member |
| 108 Treadle Support Retainer Clip | 110 Pivot Block | 112 Lumbar Support Backer |
| 120 Sliding Block | 122 Sliding Block Fastener | 140 Hammock Frame |
| 142 Bed Member | 144 Bed Support Member | 146 Bed Support Tensioner |
| 148 Bed Member Spacer | 150 Bed Member Support Stop | 152 Pillow Holder |
| 154 Pillow Header Frame Member | 156 Pillow Holder Member | |

DETAILED DESCRIPTION OF THE INVENTION

Figure 1:
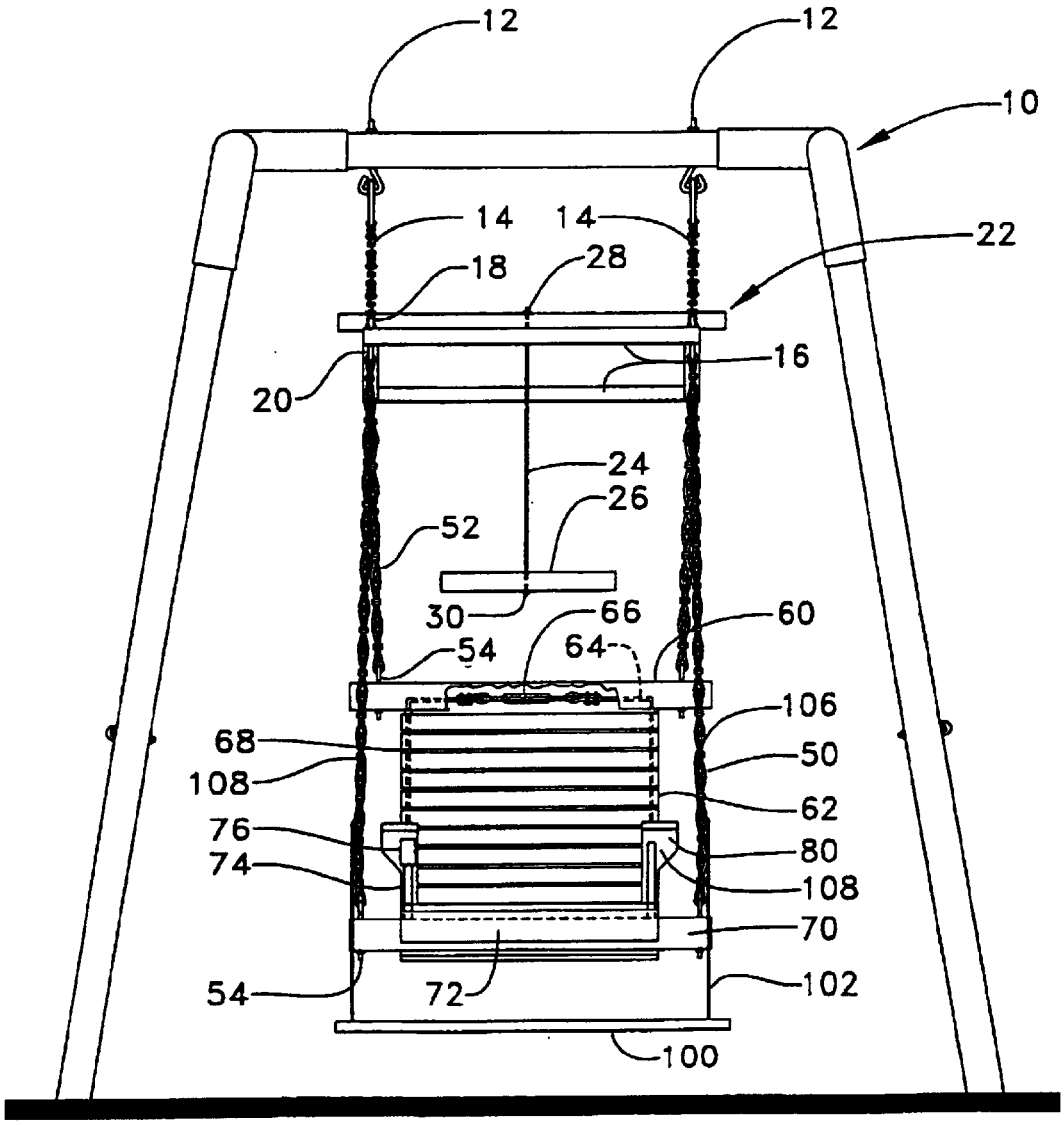
FIG. 1 is a front elevation view of one embodiment of the swing of the present invention.

This invention is best understood by reference to the drawings, wherein like numerals are used to designate similar parts throughout the several views and detail drawings. Referring now to FIG. 1, the swing is suspended from an overhead support 10, such as a porch ceiling, a tree limb or a swing frame as shown here. The support hooks 12, of which there are two, are representative of any suitable hanging device. However, the preferred embodiment employs a flat-bottomed hook with a built in bearing.

Figure 2:
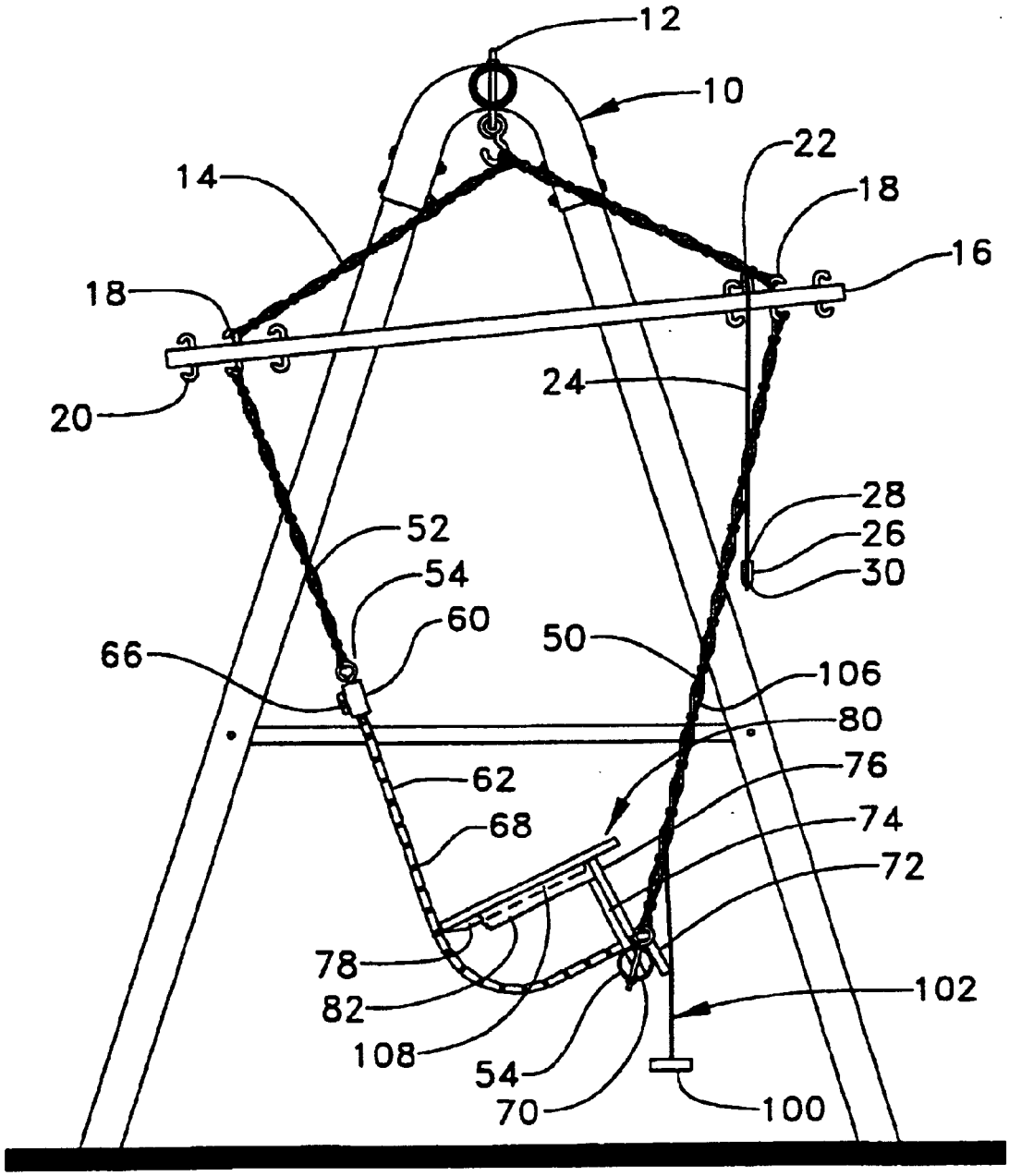
FIG. 2 shows a side elevation view thereof, eliminating part of the frame.

Referring to FIG. 2, two top flexible chords 14 are connected to the support hooks. The top flexible chords support the horizontally-mounted subplatform 16 and, accordingly, are also known as subplatform suspension members. The top flexible chords are preferably chains, but wires, ropes, cords, and other flexible lines are suitable. There are two suspension points, one on each side of the chair. The top flexible chords are adjustable at the point where they connect with the support hooks, which are their pivot point. Moving the pivot point forward or backward, by selection of a different link, changes the center of gravity and in turn the horizontal position of the subplatform.

Figure 3:
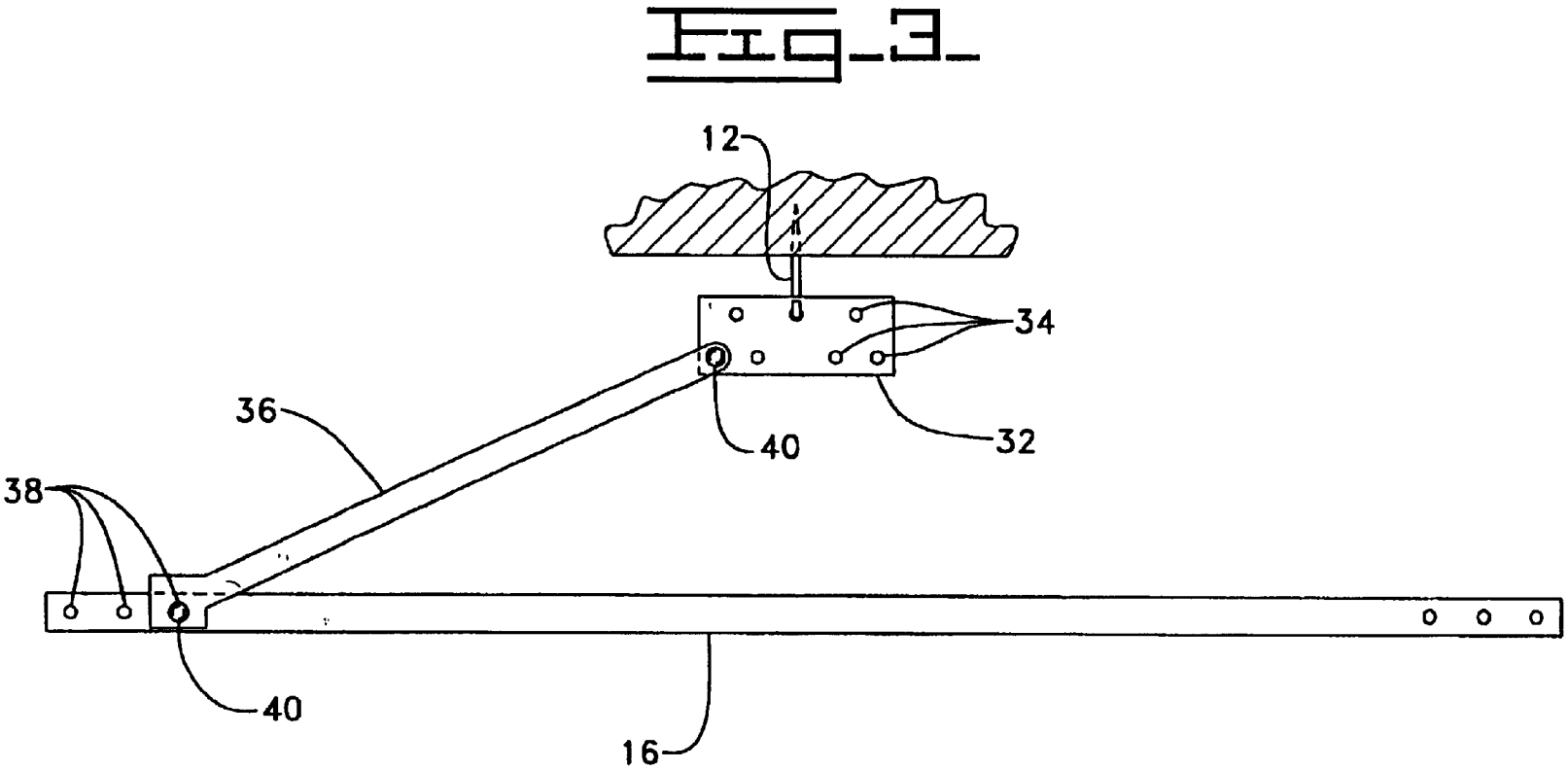
FIG. 3 is a detail showing a second alternative suspension of the subplatform.
Figure 3A:
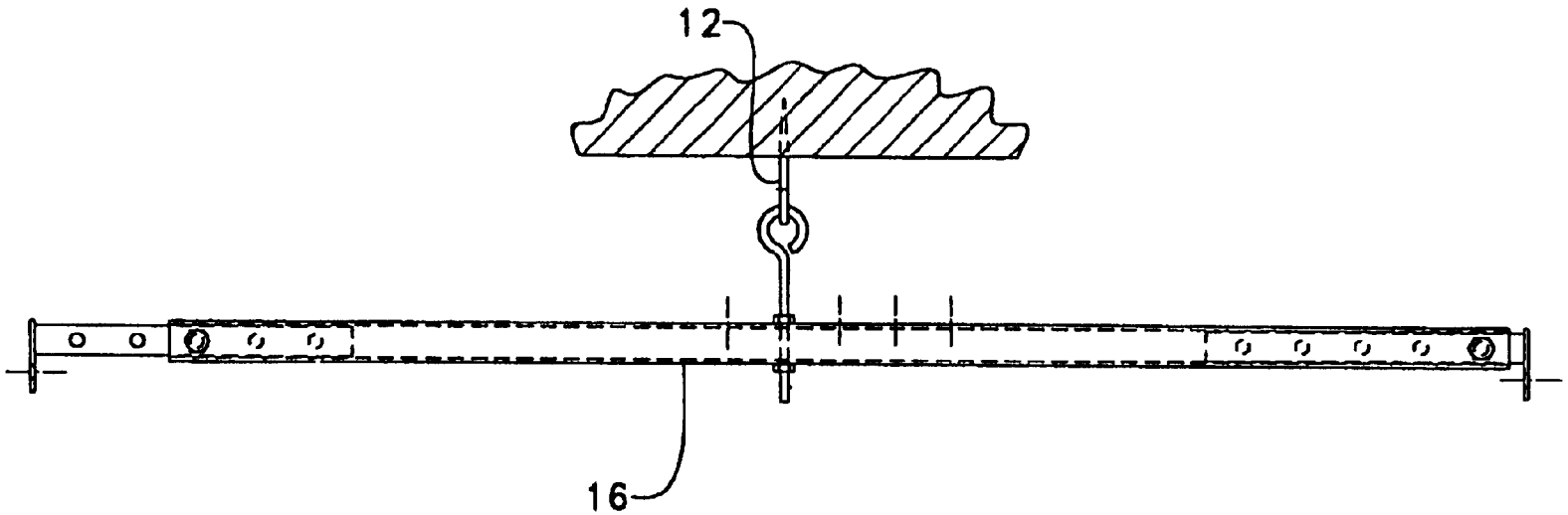
FIG. 3*a* is a detail showing a third alternative suspension of the subplatform.

FIG. 3 shows a second alternative way of suspending the subplatform by using an adjustable hanging plate 32 and top rigid chords 36. The position adjustment holes/plate 34 allows user defined selection of connection points between the support hooks and the position adjustment holes/plate. FIG. 3*a* shows a third alternative way of suspending the subplatform. This alternative is preferred. A threaded rod is hooked over a support hook and passes through a hole in the side of the subplatform. Adjusting nuts on the rod are positioned above and below the subplatform to enable the distance between the support hooks and subplatform to be adjusted. Preferably, each side of the subplatform contains several different holes so that the center of gravity and, in turn, the horizontal position of the subplatform can be adjusted.

Figure 3B:
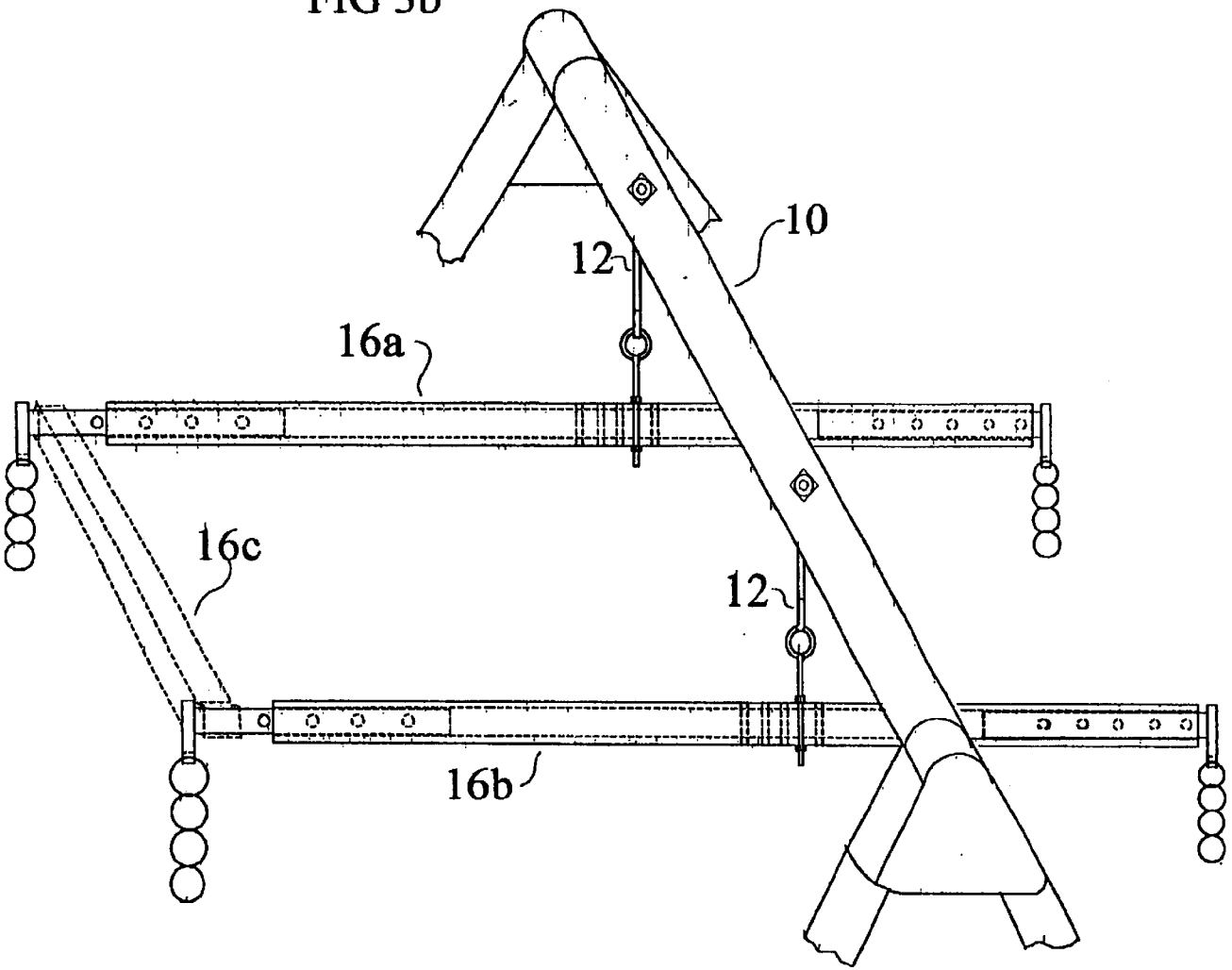
FIG. 3*b* is a detail showing a fourth alternative suspension of the subplatform.

The subplatform has two sides and is rigid. The sides are preferably directly interconnected, but may comprise two separate sections 16*a* and 16*b* as shown in FIG. 3*b* that are indirectly interconnected by the chair and by the frame. An optional stabilizing interconnector 16*c* section can be used if desired. The subplatform is preferably rectangular or U-shaped. The U-shape, with an omitted front section, is preferred because it eliminates the possibility of a user bumping his head on the subplatform as he enters or leaves the chair. As will be seen, the subplatform is primarily responsible for the swing's uniquely pleasurable rolling motion. The subplatform rocks front-to-back as the chair moves front-to-back to provide moving suspension points.

The sides of the subplatform preferably contain a means for extension. In the embodiment shown in FIG. 2, the subplatform has a series of adjustable connection points near each end of the two members forming the sides, top incremental fasteners 18 and bottom incremental fasteners 20. A second alternative method of extending is shown in FIG. 3 using adjustment holes 38 in the subplatform and removable fastener 40. A third alternative method of extension is shown in FIG. 3*a* in which the subplatform contains telescoping sections. The extension means allows adjustment in the connection between the subplatform and the overhead support and between the subplatform and the chair. In the embodiment shown in FIG. 2, the ability to accomplish adjustment is possible at each end of the top flexible chords 14 where it connects with the subplatform. Any of the top incremental fasteners selected by the user will allow changes in the horizontal position of the subplatform regardless of how the center of gravity (at upper end) is selected. The incremental connection points near the ends of the side members of the subplatform, represented by the top incremental fasteners on the top and adjustment holes subplatform through the side, are spaced from the end toward the center of each side member.

When the subplatform suspension members (either the top flexible chords or the top rigid chords) are connected to the subplatform at equal distance from center, furthest from the center, the resulting swing ride will be the most stable with the least roll. When the subplatform suspension members are connected to the subplatform at equal distance from the center, closest to center, the swing ride will exhibit the most roll. The selection of connection points between the subplatform suspension members and the subplatform may be other than equal distance from center and will in varying degree change the way the swing hangs and sits.

Figure 4:
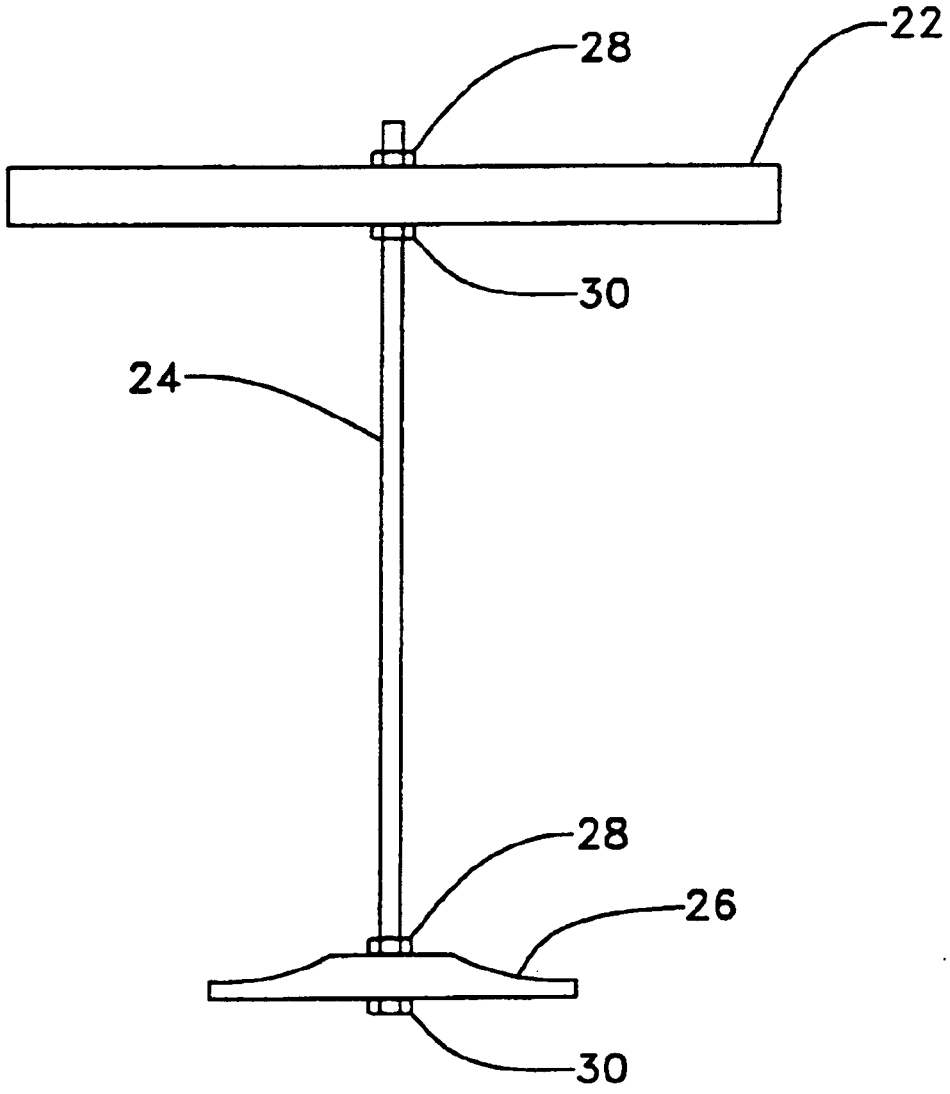
FIG. 4 is a detail of the hand operated propellant device.

The subplatform is a unique in the design and performance of swings. It interacts with the suspended chair in a way never before possible with swings using only a single or double point attachment to the support member. This interaction provides a unique motion and also allows the use of the hand-operated propellant device, shown in FIGS. 1 and 2, and detailed in FIG. 4. There are three main components to the propellant device: (1) the upper member propellant 22; (2) the lower member propellant 26; and (3) the connecting member propellant 24. These three components are held together by top-side retainer 28 and bottom-side retainer 30. The upper member propellant is connected to the subplatform and may be made of wood, plastic, metal or any suitable material. The connecting member propellant may be flexible or rigid. If the connecting member propellant is rigid, the upper member propellant can be placed, moved, or adjusted from the seat as desired.

The rear chair suspension members 52, shown here as a chain, connect the bottom incremental fasteners 20 of the subplatform with the connector 54 of the chair. The rear chair suspension members are separated from the subplatform suspension members. The rear chair suspension members preferably converge from the subplatform to the chair. In other words, the distance between the rear suspension members at the subplatform is greater than the distance between them at the chair. User-selected connections between rear suspension members and the bottom incremental fasteners determine the following: (1) the vertical angle of the back; (2) the at-rest position of the subplatform; (3) the length of the arc of the swing; and (4) the at-rest height of the swing. Accordingly, this a valuable option in the adjustability and personalization of the swing.

The back support member 60 of the chair is supported directly by the connector. The chair utilizes a plurality of elongated lateral crosspieces, shown as seat member 62. All have orifices at opposite ends through which passes a flexible member, shown as seat support member 64. Typically, this flexible member may be a rope, cable or the like, and is preferably one piece. Between each seat member is a seat member spacer 68 which may be rigid or flexible. The preferred embodiment shown is a rubber type bushing. Beginning at the back right side of the back support member, the seat support member is threaded through the back support member, exiting the bottom in a vertical attitude, passing through a seat member spacer. It continues vertically through a seat member, and so on, repeatedly until the front support member 70 is reached.

The attitude of the seat support member at this point will have undergone a transition from vertical to horizontal. The seat support member enters the front support member from the rear and exits the bottom. Going immediately left under the seat support transition cover 72 to the left side of the front support member 70, entering the bottom, turning up (vertical), and exiting the back, now in a horizontal attitude once again. The seat support member again enters a seat member spacer into a seat member, and so on until reaching the back support member. The seat support member enters the orifice at the bottom of the back support member again in a vertical mode, and exiting the back turning toward the center of the swing.

With both ends of the seat support member in close proximity of the center of the swing back, the seat support tensioner 66 can be a commercially available eyebolt arrangement attached to each end of the seat support member and, after having the ends secured by clamps, tension can be applied to the desired compactness. An alternative and preferred location for the seat support tensioner is under the seat portion of the chair behind the seat support transition cover.

The front chair suspension members 50 connect the bottom incremental fasteners 20 of the subplatform and the connectors 54 of the chair. The front chair suspension members are separated from the subplatform suspension members. The front suspension members preferably converge from the subplatform to the chair. In addition to providing support for the front portion of the swing, the front suspension members, depending on where they are fastened to the bottom incremental fasteners, will determine the following parameters: (1) the vertical angle of the front chain (hanging angle of inclination of the footrest); (2) the at-rest position of the subplatform (raised in front for tall people); (3) the length of the arc of the swing; (4) the at-rest height of the swing; and (5) the at-rest height of the front of the swing (relative to the seat and back. Additionally, the front suspension members provide a convenient vehicle for the incremental adjustments for the footrest. This adjustment is important to the performance and comfort of the person using the swing.

Figure 7:
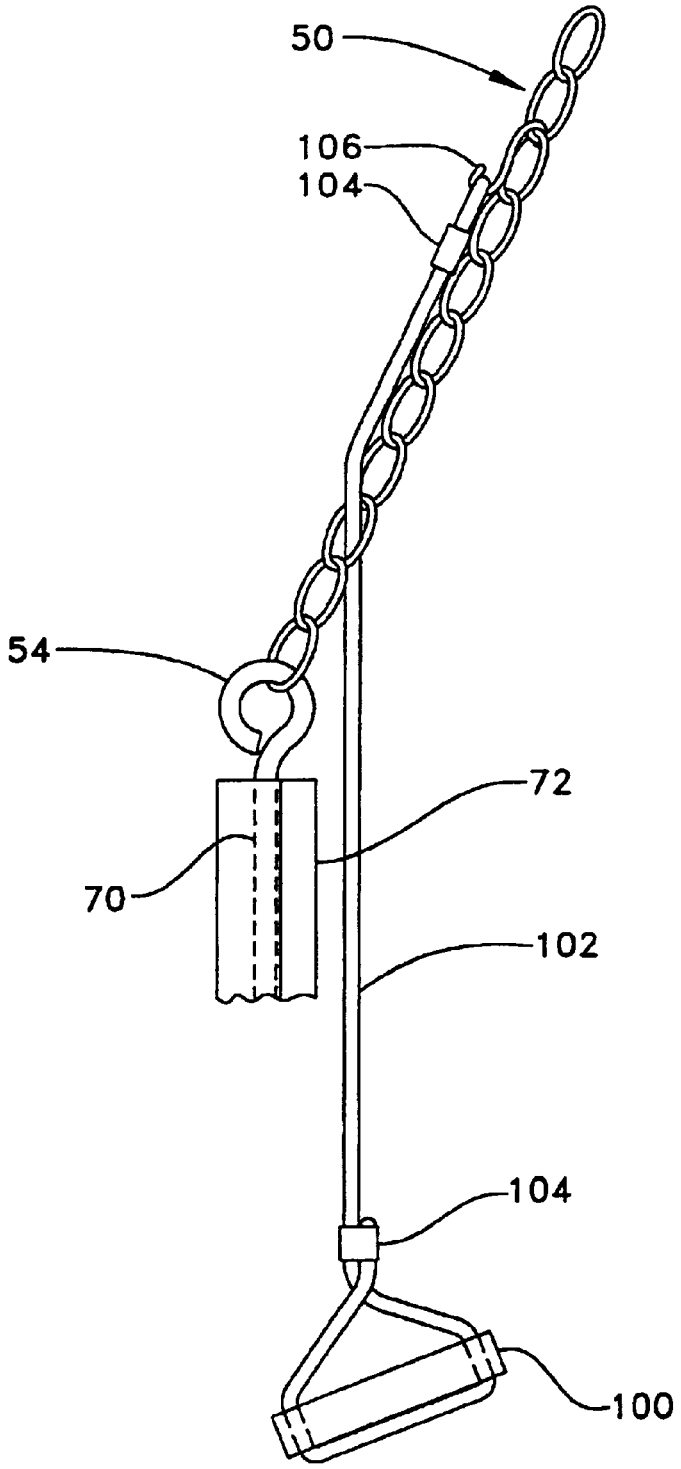
FIG. 7 is a detail of the area where the footrest pivots and is hooked into the chain to determine height of footrest.

FIG. 7 illustrates the footrest. The footrest includes a treadle support 102 that enters the foot treadle 100 from the top traversing across the underside, almost to the front edge, then entering the foot treadle again, from the bottom, and continuing a short distance to where it is terminated at fastener 104, being fastened to itself at that point. The upper end of the treadle support enters and passes through a link of front chair suspension member 50. The link becomes the pivot point for the foot treadle. The link should be chosen to correspond approximately with the length of the user's leg, from the knee to the bottom of the foot. The treadle support continues on up the front suspension members a short distance where in is terminated at treadle support fastener 104, being clamped to a hook, treadle support termination member 106. The exact point on the front suspension member that the user decides to place the hook is decided based on comfort.

Figure 8:
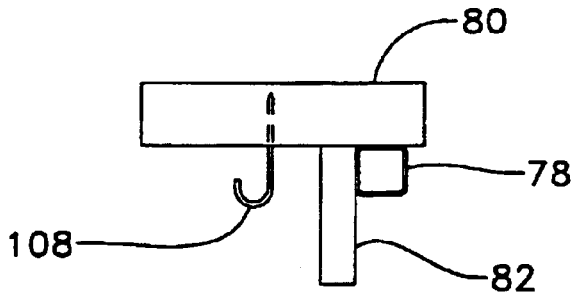
FIG. 8 is a rear view detail of the arm rest where the treadle support cable is fastened when not in use.
Figure 9:
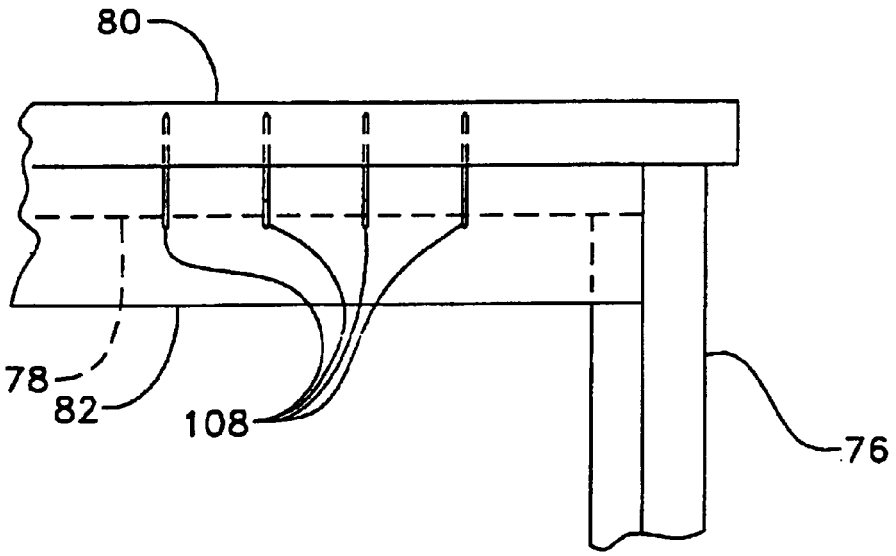
FIG. 9 is a side view detail thereof.

The combination of materials and construction of the foot treadle and treadle support provide for a unique benefit. As desired by the user, the attitude of the foot treadle may be changed simply by applying downward pressure with the foot and gently forcing the treadle support to be slipped through the foot treadle either way. Yet another benefit provided by the use of a flexible treadle support is that it can be temporarily fastened to the body of the chair as detailed in FIGS. 8 and 9. This illustrates how the treadle support can be grasped at a point lower than the front support member 70, using both hands, one on each side of the chair. Because the treadle support is flexible, it can be drawn toward the rear of the chair, and at the same time raising the portion in hand. This has the effect of raising the foot treadle up toward the bottom of the chair seat and, at the same time, moving it rearward. One or more treadle support retainer clips 108, preferably J hooks, may be secured under the arm rest. The user may select the appropriate hook on which to temporarily deposit the treadle support. It is intended that the foot treadle would normally be retained in this elevated position any time the chair is not occupied. The foot treadle is then returned to its normal operating position after the user has gained entry to the chair and is ready to use the foot treadle. To return the foot treadle to its operating position one has only to unhook the treadle support and let go of it. It will return to the working position on its own.

Figure 5:
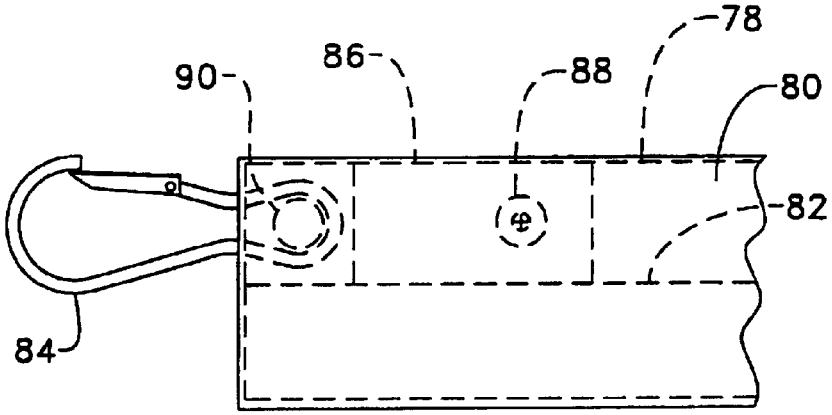
FIG. 5 is a top view detail of the area of the rear of the armrest where it fastens to the back.
Figure 6:
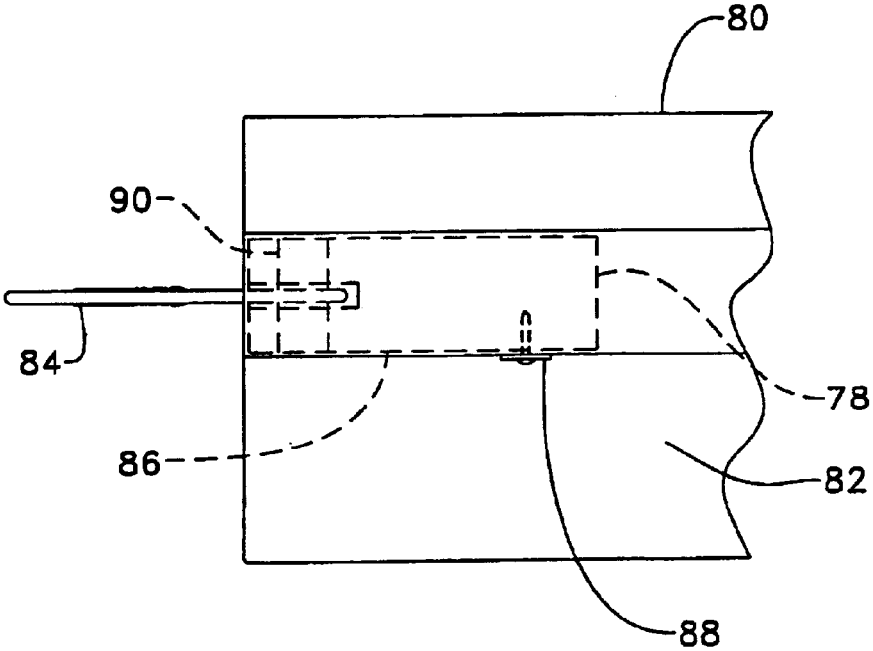
FIG. 6 is a side view detail of the area of the rear of the armrest where it fastens to the back.
Figure 5A:
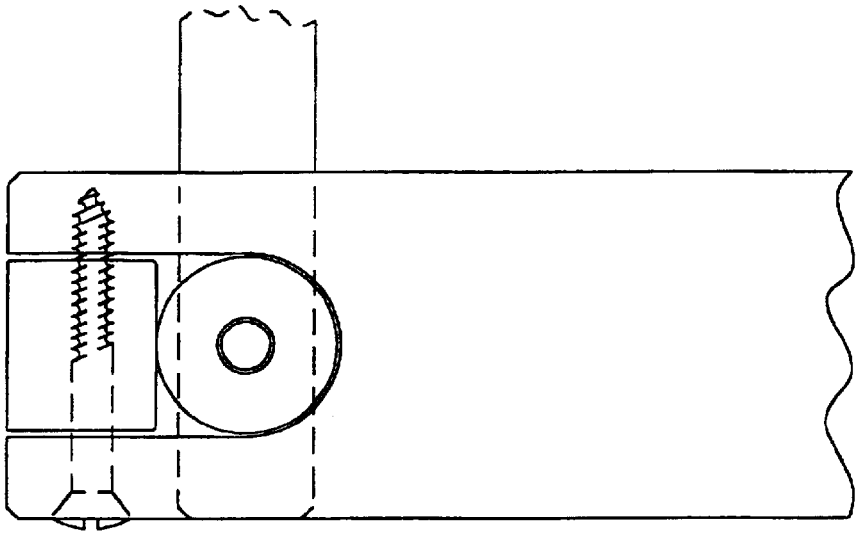
FIG. 5*a* is a detail showing an alternative fastening.
Figure 6A:
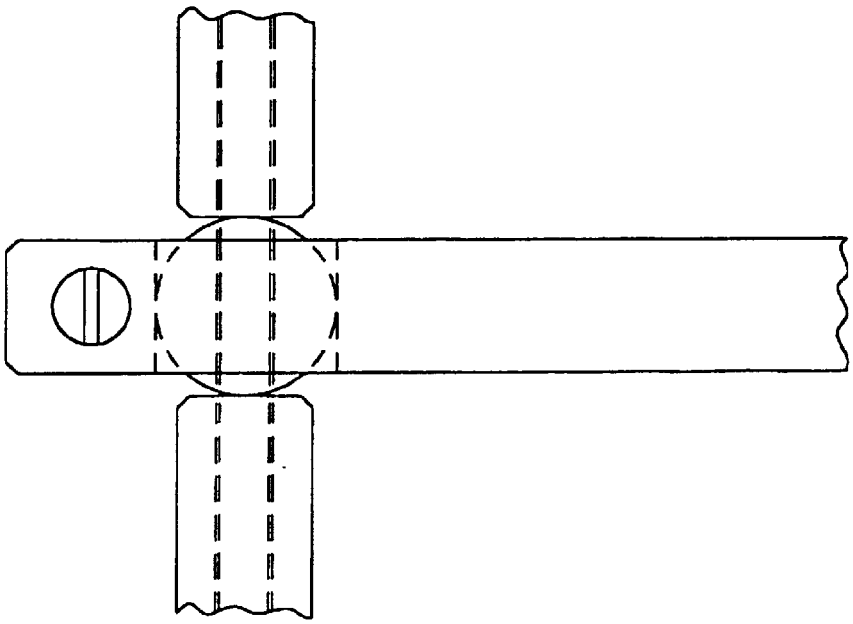
FIG. 6*a* is a detail showing an alternative fastening.

The lower end of the vertical arm rest support 74 is fastened to the front support member 70. The upper end is fastened to the horizontal arm rest support 78. The vertical arm rest support cover 76 is anchored to the front of the vertical arm rest support and furnishes support to the front end of the arm rest 80. The arm rest is anchored to the top side of the horizontal arm rest support which is preferably made of square steel tubing. FIG. 5 shows a slotted plug 86 in top view while FIG. 6 shows the same details from a side view. A wooden plug is made of a thickness and width to just be able to fit into the horizontal arm rest support 78. The length is determined by adding two inches to the depth of the slot. After selecting the proper size of arm rest to back fastener 84, the small end is used to size the arm rest to back fastener retainer pin 90, it should be able to pass through unhindered. A hole is drilled in slotted plug 86, of sufficient size to accept the arm rest to back fastener retainer pin 90. The hole is centered for width and is of sufficient depth to allow the arm rest to back fastener 84 to wobble or have limited side movement. After cutting a slot of sufficient thickness and depth to accept the arm rest to back fastener, it is placed in the slot, centered for width, and the arm rest to back fastener retainer pin 90 is installed in the hole previously drilled (top to bottom). Next the combination is slid into the horizontal arm rest support 78, until the slotted plug 86, is flush with the back of the horizontal arm rest support 78, and the slotted plug retainer 88 is installed. Next the arm rest to back fastener 84 is wobbled to the outside, and held there while the back of the swing is pulled near. After selection of the typical seat member spacer 68, the spacer selected is pushed past the hinged portion, and into the cavity of the arm rest to back fastener 84. The horizontal arm rest support cover 82 is secured to the horizontal arm rest support 78 on the outside with the top edge stopped against the bottom of the arm rest 80. A more preferred connection of the arm rest is shown in FIGS. 5*a* and 6*a*. The back end of the arm rest contains a recess that fits over a seat member spacer. A retaining block is then fixed in position behind the spacer with a screw, bolt, or other fastener.

FIG. 10 shows a pivot block 110 that is five units square along with the placement of the pivot point hole. Four such blocks are shown in FIG. 11, each arranged or configured to provide varying degrees of lumbar support. The lumbar support backer 112, of which two are required, one near each end of the affected seat member, has an area at each end of slot for fastening. After choosing the approximate location to apply the lumbar support, the lumbar support backer is fastened securely to the seat member closest to the selected location. The fastening location at the other end of the lumbar support backer is "timed" to set directly over another seat member. The number of seat members affected will be determined by the design of the lumbar support backer. However, the preferred embodiment employs four typical pivot blocks, two transition and two fastened seat members.

Since each pivot block is the same size and shape, the drilled holes through the lumbar support backer should be spaced an equal distance apart. They should fall under a seat member. They should be spaced from the front edge of the lumbar support backer only the distance required for the shortest side of the pivot block to protrude in front of the face of the lumbar support backer. The pivot block is installed in the slot of the lumbar support backer and held in place by a dowel that protrudes through both. The chair will need to be empty of passengers, when the degree of lumbar support is selected or changed. Manual pinning of each individual pivot block is all that is required.

FIG. 12 shows a sliding block 120 which is made to be one unit thick and three units long. The sliding block is used in conjunction with the lumbar support block, as seen in FIG. 13, to provide lumbar support in varying degrees and different locations. Two screws and washers, typical sliding block fasteners 122 of sufficient length to pass through the lumbar support backer slot and penetrate the sliding block, are needed. The sliding block, while loosely fastened in place, may be slid up or down to the user selected location and held there by tightening the sliding block fasteners to lock the two units together. At the user's discretion, the sliding block may be taken out, turned 180 degrees, and re-installed, giving yet another variation of lumbar support.

Figure 15:
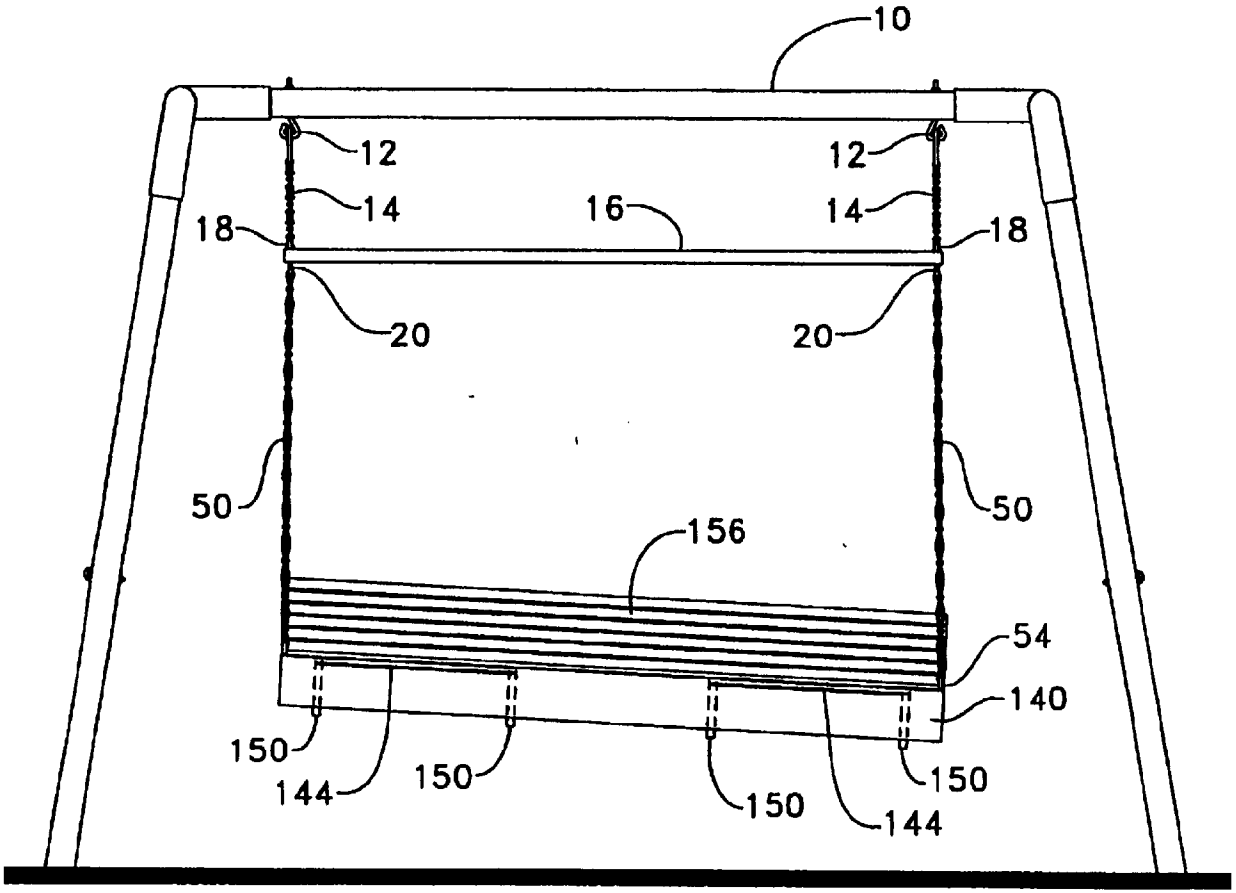
FIG. 15 is a front elevation view of a hammock embodiment with one end raised

A hammock embodiment of this invention is shown in FIGS. 15 to 21. As shown in FIG. 15, the upper structure of this embodiment remains about the same as the prior described embodiment. The length of the front suspension members are of different length to provide the user an opportunity to swing with his head elevated. The hammock frame 140 makes up the perimeter and is supported by the front suspension members and the rear suspension members near the four corners.

Figure 16:
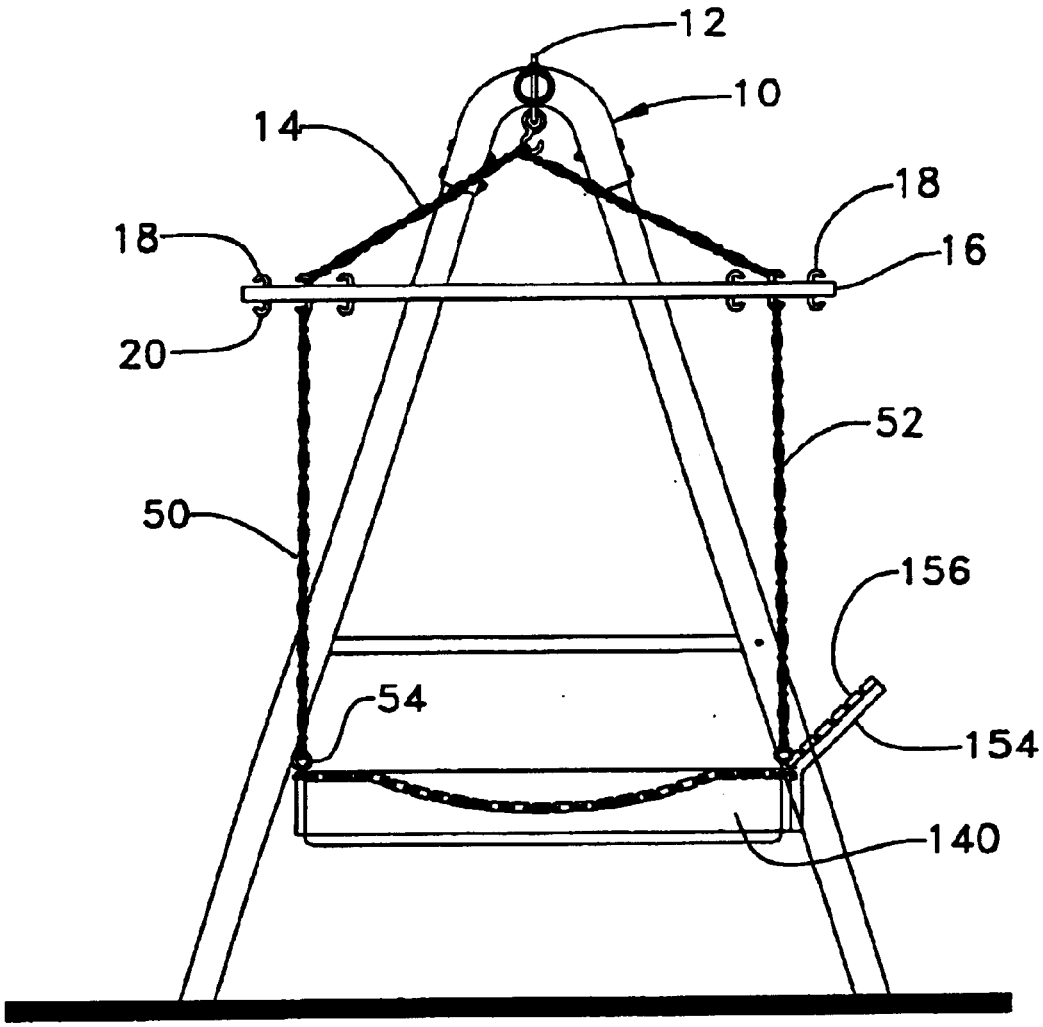
FIG. 16 is a side elevation view thereof
Figure 17:
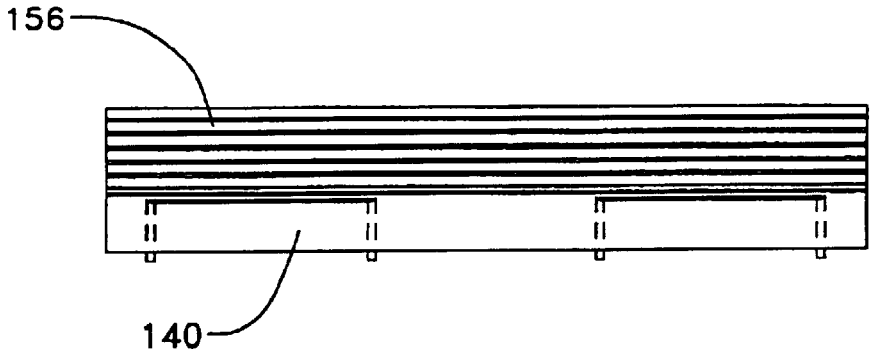
FIG. 17 is a front view detail of the hammock.
Figure 18:
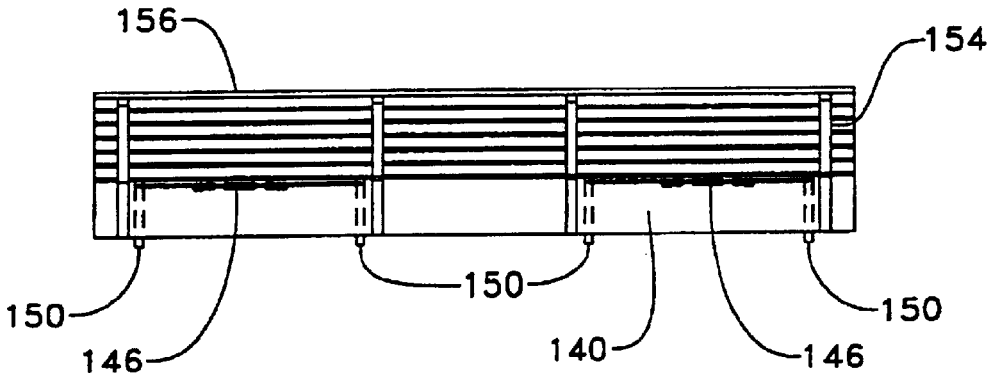
FIG. 18 is a rear view detail thereof.

FIG. 16 illustrates a pillow holder 152 and its two individual members, a pillow holder frame member 154, of which there are four, and a pillow holder member 156, shown in front view in FIG. 17, and from the rear in FIG. 18. The pillow holder members are fastened directly to the typical pillow holder frame member by nails, screws, glue or the like. Also shown in FIG. 18 are the two bed support tensioners 146.

Figure 19:
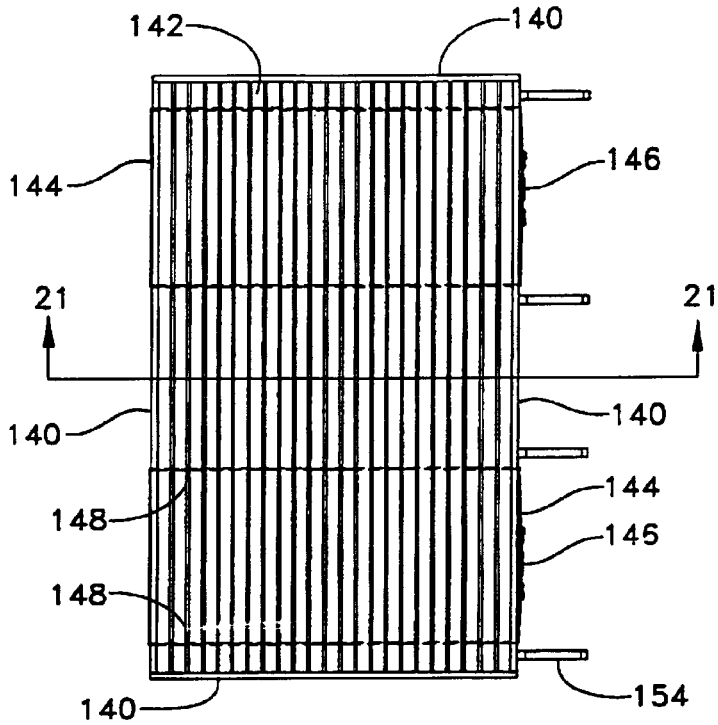
FIG. 19 is a top view detail thereof.
Figure 20:
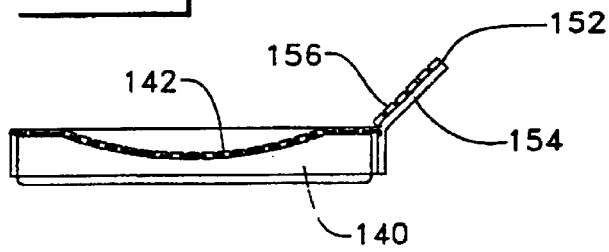
FIG. 20 is a side view detail thereof.

FIG. 19 shows how the bed support member 144 begins outside the hammock frame, enters at the rear (under the pillow holder), and then passes through a bed member spacer 148. Next, it passes through a bed member 142, and so on until it exits the front of the hammock frame. There it turns to the left immediately, goes approximately one third the length of the front frame member, where it makes another left turn entering the hammock frame 140. Then proceeding rearward passing through a bed support member spacer, next through a bed member, and so on until the hammock frame is passed through. Whereupon a left turn is accomplished and both ends of the bed support member are in close proximity of each other. The bed support tensioner is then attached to each end of bed support member. After having each end secured by some clamping device, tension can be applied to the desired compactness. This procedure is repeated for the other end of the hammock.

Figure 21:
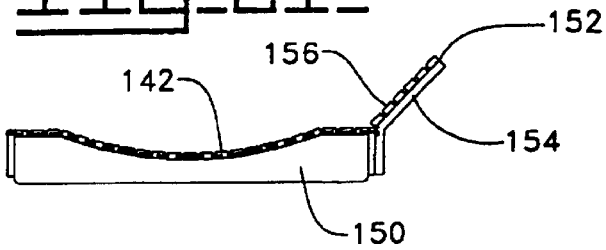
FIG. 21 is a sectional view taken along line 21—21 in FIG. 19.

FIG. 21 is a sectional detail showing the configuration of one of four bed member support stops 150. They are preformed in this configuration to cradle the user as the bed support members 144 stretch under weight. As FIG. 15 indicates, the bed support members pass directly over the bed member support stops, which extend slightly below the lower edge of the hammock frame.

FEATURES OF THE INVENTION

The swing of this invention has many new features. The first new feature is that the top (rigid or flexible) chord members supporting the subplatform can be balanced, (hung in the center, hole or link). They also can be incrementally moved off center, forward or backward, to achieve varying degrees of difference to true horizontal. This allows the user more headroom when chair/swing is at rest and it is desirable for the subplatform to be higher or lower in the front.

All embodiments are supported by a subplatform with attachment at or near each corner of said subplatform. There are adjustment hooks or holes spaced near each corner of the subplatform. Depending on user's selection of where fastening is accomplished, three various parameters will be determined: (1) the subplatform trajectory; (2) the length of arc, and (3) the at-rest position of subplatform. Additionally, the prior art has not suggested or taught that a subplatform could be built with incremental connection points, top and bottom, individual yet dependent on each other, to accomplish controlled shifting and tilting. This can be both a pleasurable experience and at the same time therapeutic.

Further, the present invention teaches that arm powered propulsion and control of the swinging movement can be achieved by manipulating the relationship between the seat and the subplatform. The mechanism used does not get removed from the field of reach of the occupant because the occupant and device move together.

Because of the unique relationship between the subplatform and whichever embodiment happens to be hanging on it, when the hand-operated propellant device is used and a downward force is applied to the top outside end (either one) of the subplatform, it causes the hanging embodiment to move in that direction. The immediate release of the applied pressure conversely causes the subplatform to rise and the hanging embodiment to begin moving back towards its original position.

A repetition of this action causes the hanging embodiment to begin a swinging action that can if continued result in a larger and larger arc or swinging path. All this without direct contact with either the frame or the ground, in effect creating an environment where not just a handicapped person, but a handicapped person without legs, once deposited in either hanging embodiment can not only initiate, and continue the swinging action, but could also retard or stop such action at their sole discretion.

User selected connections on the bottom side of the subplatform will determine the following six things: (1) the vertical angle of the back; (2) the vertical angle of the front chain (hanging angle of inclination of the footrest); (3) the at-rest position of the subplatform (raised in front for tall people); (4) the length of the arc of the swing; (5) the at-rest height of the swing; and (6) the at-rest height of the front of the swing (relative to the seat and back).

The chair utilizes a plurality of elongated lateral crosspieces. Some of these form a base or bottom and at some point, as they begin to go up, form the back of the chair. All have orifices at opposite ends, through which passes a flexible member. Each elongated lateral crosspiece is separated from the other by a spacer, which also has a flexible member passing through each. A tensioning device is located at the back side of the swing near the top, and will prevent slack or space from developing between members when properly used. This provides for a flexible back and seat that is form fitting.

The present invention employs an arm rest that is able to be connected at various locations on the back of the swing, without having to dismantle the swing. Employing a built-in clip that will encircle a spacer and operate unhindered between the elongated lateral crosspieces, has the effect of providing three benefits: (1) leveling or otherwise re-positioning of the angle of the arm rest; (2) raises or lowers the point on the lower back where lumbar support is needed; and (3) changes the roundness of the seat bottom to allow a full figured, robust person more room and comfort, by providing more space in the seat area. Depending on where (up or down) the clip is fastened in the back, it can at the same time provide lumbar support, which can be increased by occupant applied pressure to the top front of the armrest. Additionally, two embodiments are shown which allows the user, independent control over the amount and placement of lumbar support.

Further, nothing in the prior art teaches or suggests that a swing with flexible members could provide varying degrees of lumbar support. This can be achieved by both changing the amount of pressure applied to the lower back, and also by changing the placement of such said pressure up or down, through adjustments at the arm rest and the chair/swing back or through the manipulation, by the individual of the lumbar support mechanism as taught in the present invention.

The way the swing is designed, built and constructed creates an environment that allows the vector forces of the flexible members to apply lumbar support to the occupant in direct proportion to occupants weight and swinging activity. Such that easier swinging by smaller people, will experience less lumbar pressure applied to their back than would for example more aggressive swinging by a larger person. Notwithstanding the above prior art, there is no teaching or suggestion that a footrest used for comfort and occupant applied propulsion could be achieved by using flexible members.

The present invention provides numerous incremental connections of the pivot points, up and down, in and out, (as the selected pivot point goes up, it is moved out or away from the seat and conversely, when selection of pivot point is down it is moved closer to the occupant). The pivot points can be easily moved to accommodate the physical differences of the users, in fact the user may decide to move the pivot points simply because he or she desires a change.

The relationship between the footrest and the swing body is instantly changed by simply raising or lowering the hook fastened to the end of the footrest support. This is very important to the comfort of the occupant as it controls not only the ease with which propulsion is achieved and maintained, but it also allows the swing occupant to determine the amount of pressure felt in the area behind the knees. In fact if the footrest/treadle were raised slightly higher than normal there need be no pressure felt behind the knees at all.

An additional benefit provided by the use of a footrest using flexible members is that said flexible members giving the footrest support can be temporarily fastened to the body of the chair/swing, at a second point. Hooked under the arm rests, thereby moving the footrest/treadle, up and toward the rear. This allows for totally unhindered ingress and egress by either the individual using the swing and/or someone additionally there to assist that individual if he or she were handicapped Still another benefit taught by the present invention is the adjustment ability of the angle of the footrest relative to occupant. The Fry swing discussed above teaches a footrest that is static in its relationship to the user or the ground. Because a cable or the like runs through the footrest in front and back (each side), the cable or the like can be slipped to effect a change in attitude, where the user needs or wants such adjustment or change in pitch.

The embodiment best described as a semi-rigid hammock has certain characteristics that make it unique in its action when hung from the subplatform. Since the hammock is hung from its four corners, or near its four corners, directly up to the corners of the subplatform it creates a rolling action, much like the chair. However in addition to this beneficial action, one can choose to raise either end above the other and swing in that position. If the hammock were anchored at only one point on each end, not only would entry and egress be difficult, but swinging would result in the raised side getting out of time with the lowered side and rather quickly the swinging would be terminated. However, the hammock of this invention can and will support a full grown man sitting on the edge, without dumping him off. With the hammock elevated at one end, the reaction between the subplatform and the hammock is such that the raised end stays in time with the lower end, except in the most vigorous swing action.

Another feature is the fact that the user is lying on semi-rigid slats that allow the bed to give in the center. The amount of that depression is controlled by the tension applied to the bed support member. Below that are four contoured stops spaced beneath the typical bed members. A final feature is the pillow holder built at the backside of the hammock. Its primary purpose is to contain items user has brought to the hammock for comfort or pleasure. Items such as a pillow, blanket, book, radio or the like, and keep them from falling down off the backside.

I claim:

1. A swing that moves with a front-to-back pendular motion, the swing comprising:

(a) an elevated support having two hooks that are spaced apart perpendicularly to the direction of motion of the swing;

(b) a horizontally-mounted subplatform having two sides, each side having a front corner and a rear corner, (c) subplatform suspension members running from the hooks of the elevated support to the subplatform, the subplatform suspension members suspending the subplatform;

(d) a chair having a front, a back, and two sides; and (e) a front chair suspension member and a rear suspension member on each side of the chair, the front chair suspension member running from and attached to the front side corner of the subplatform to the front side of the chair, the rear chair suspension member running from and attached to the rear side corner of the subplatform to the rear side of the chair, the front and rear suspension members suspending the chair, the front and rear chair suspension members being separated from the subplatform suspension members.

2. The swing of claim 1 wherein the two sides of the subplatform are interconnected.

3. The swing of claim 1 wherein the front chair suspension members and the rear chair suspension members converge from the subplatform to the chair.

4. The swing of claim 1 additionally comprising a footrest propellant comprising a foot treadle suspended by a flexible cable connected to each front chair suspension member.

5. The swing of claim 1 wherein the subplatform suspension members comprise threaded rods.

6. The swing of claim 1 wherein the subplatform contains extension means to adjust the distance between the front and rear chair suspension members on each side.

7. The swing of claim 1 additionally comprising a hand-operated propellant comprising a bar suspended from the subplatform by a connecting member a sufficient distance to place the bar within convenient reach of a person in the chair.

8. A swing that moves with a front-to-back pendular motion and that is adapted for suspension from an elevated support having two hooks that are spaced apart perpendicularly to the direction of motion of the swing, the swing comprising:

(a) a horizontally-mounted subplatform having two sides, each side having a front corner and a rear corner;

(b) subplatform suspension members adapted for running from an elevated support having two hooks to the subplatform, the subplatform suspension members suspending the subplatform;

(c) a chair having a front, a back, and two sides; and (d) a front chair suspension member and a rear suspension member on each side of the chair, the front chair suspension member running from and attached to the front side corner of the subplatform to the front side of the chair, the rear chair suspension member running from and attached to the rear side corner of the subplatform to the rear side of the chair, the front and rear suspension members suspending the chair, the front and rear chair suspension members being separated from the subplatform suspension members.

9. The swing of claim 8 wherein the two sides of the subplatform are interconnected.

10. The swing of claim 8 wherein the front chair suspension members and the rear chair suspension members converge from the subplatform to the chair.

11. The swing of claim 8 additionally comprising a footrest propellant comprising a foot treadle suspended by a flexible cable connected to each front chair suspension member.

12. The swing of claim 8 wherein subplatform suspension members comprise threaded rods.

13. The swing of claim 8 wherein the subplatform contains extension means to adjust the distance between the front and rear chair suspension members on each side.

14. The swing of claim 8 additionally comprising a hand-operated propellant comprising a bar suspended from the subplatform by a connecting member a sufficient distance to place the bar within convenient reach of a person in the chair.

* * * * *